US010751901B2

(12) United States Patent
Benkö

(10) Patent No.: US 10,751,901 B2
(45) Date of Patent: Aug. 25, 2020

(54) CUTTING TOOL, AND A METHOD FOR CUTTING A WEB OR SHEET OF MATERIAL

(71) Applicant: Tetra Laval Holdings & Finance S.A., Pully (SE)

(72) Inventor: Gabor Benkö, Lund (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 16/301,570

(22) PCT Filed: May 15, 2017

(86) PCT No.: PCT/EP2017/061617
§ 371 (c)(1),
(2) Date: Nov. 14, 2018

(87) PCT Pub. No.: WO2017/198621
PCT Pub. Date: Nov. 23, 2017

(65) Prior Publication Data

US 2019/0176358 A1 Jun. 13, 2019

(30) Foreign Application Priority Data

May 16, 2016 (EP) ..... 16169774

(51) Int. Cl.
*B26F 1/44* (2006.01)
*B26F 1/14* (2006.01)
(Continued)

(52) U.S. Cl.
CPC ..... *B26F 1/44* (2013.01); *B26D 7/204* (2013.01); *B26F 1/14* (2013.01); *B26F 1/02* (2013.01);
(Continued)

(58) Field of Classification Search
CPC .... B26F 1/384; B26F 1/14; B26F 1/40; B26F 1/44; B26F 1/02; B26F 1/08; B26F 1/18;
(Continued)

(56) References Cited

U.S. PATENT DOCUMENTS 3,373,643 A 3/1968 Maximilian
3,823,633 A * 7/1974 Ross ..... B26D 7/20 83/346
(Continued)

FOREIGN PATENT DOCUMENTS

DE 19502164 7/1995
GB 1 303 838 1/1973
JP H08-25297 A 1/1996

OTHER PUBLICATIONS

International Search Report for International Application No. PCT/EP2017/061617 dated Jun. 26, 2017 in 2 pages.
(Continued)

*Primary Examiner* — Omar Flores Sanchez
(74) *Attorney, Agent, or Firm* — Knobbe, Martens, Olson & Bear LLP

(57) ABSTRACT

The present invention relates to a cutting tool (100) for providing holes in a core material layer (10). The cutting tool (100) comprises a cutting knife (110) having a cutting edge (112) configured to cut through the core material layer (10), and a support structure (120) onto which the cutting knife (110) is attached, wherein the support structure (120) is at least partly formed by an elastic material.

13 Claims, 3 Drawing Sheets

(51) Int. Cl.

| | |
|---|---|
| ***B26D 7/20*** | (2006.01) |
| *B26F 1/20* | (2006.01) |
| *B26F 1/08* | (2006.01) |
| *B26F 1/40* | (2006.01) |
| *B26F 1/02* | (2006.01) |
| *B26F 1/18* | (2006.01) |
| *B26F 1/38* | (2006.01) |

(52) U.S. Cl.
CPC . *B26F 1/08* (2013.01); *B26F 1/18* (2013.01); *B26F 1/20* (2013.01); *B26F 1/384* (2013.01); *B26F 1/40* (2013.01); *B26F 2001/4409* (2013.01)

(58) Field of Classification Search
CPC ..... B26F 1/20; B26F 2001/4409; B26F 2001/4472
See application file for complete search history.

(56) References Cited

U.S. PATENT DOCUMENTS

| | | | | |
|---|---|---|---|---|
| 4,073,208 | A * | 2/1978 | Kirkpatrick | B26D 7/20 492/53 |
| 4,289,055 | A | 9/1981 | Von Schriltz | |
| 5,047,607 | A * | 9/1991 | Briffod | B23H 7/108 219/69.12 |
| 5,471,901 | A * | 12/1995 | Nishiya | B21D 28/24 83/136 |
| 5,791,219 | A * | 8/1998 | Ochsner | B26D 7/2614 83/331 |
| 5,809,858 | A | 9/1998 | DeRoo, Sr. | |
| 6,203,482 | B1 | 3/2001 | Sandford | |
| 6,378,409 | B1 * | 4/2002 | Reid | B26D 5/02 270/58.07 |
| 9,636,835 | B2 * | 5/2017 | Buss | B26D 1/22 |
| 10,391,657 | B2 * | 8/2019 | Ferguson | B26F 1/20 |
| 2003/0079594 | A1 * | 5/2003 | Kemper | B26F 1/44 83/698.31 |
| 2006/0037452 | A1 * | 2/2006 | Grenier | B26D 1/405 83/469 |
| 2009/0100975 | A1 * | 4/2009 | Grenier | B26D 1/405 83/347 |
| 2011/0120283 | A1 * | 5/2011 | Serra Obiol | B26D 7/20 83/347 |
| 2012/0055305 | A1 * | 3/2012 | Betti | B26D 1/626 83/436.3 |
| 2012/0111166 | A1 * | 5/2012 | Yamada | B26D 7/1818 83/117 |
| 2012/0132047 | A1 * | 5/2012 | Iori | B26D 7/1818 83/136 |
| 2013/0036889 | A1 * | 2/2013 | Aichele | B26D 7/2628 83/343 |
| 2013/0094891 | A1 * | 4/2013 | Annerstedt | B26D 9/00 400/621 |
| 2014/0260438 | A1 * | 9/2014 | Matsumura | B26F 1/02 69/2 |
| 2016/0332315 | A1 * | 11/2016 | Sim | B26F 1/384 |
| 2017/0106555 | A1 * | 4/2017 | Yamamoto | A61F 13/15723 |
| 2017/0232632 | A1 * | 8/2017 | Warll | B26D 7/204 83/659 |
| 2018/0001505 | A1 * | 1/2018 | Smithwick, Jr. | B26F 1/384 |
| 2018/0036899 | A1 * | 2/2018 | Allen | B26F 1/44 |
| 2018/0178479 | A1 * | 6/2018 | Kellermann | B26F 1/44 |
| 2019/0152087 | A1 * | 5/2019 | Martensson | B26F 1/14 |
| 2019/0152182 | A1 | 5/2019 | Hedberg | |
| 2019/0176358 | A1 * | 6/2019 | Benko | B26D 7/204 |

OTHER PUBLICATIONS

Written Opinion of the International Searching Authority for International Application No. PCT/EP2017/061617 dated Jun. 26, 2017 in 4 pages.
Extended Search Report for European Application No. 16169772.7 dated Dec. 20, 2016 in 6 pages.
Extended Search Report for European Application No. 16169773.5 dated Dec. 20, 2016 in 6 pages.
International Search Report and Written Opinion for Application No. PCT/EP2017/061616 dated Jun. 19, 2017 in 8 pages.
International Search Report and Written Opinion for Application No. PCT/EP2017/061618 dated Jul. 4, 2017 in 10 pages.
U.S. Appl. No. 16/302,041, A Cutting System, and a Method for Cutting a Web or Sheet of Material, filed Nov. 15, 2018.
U.S. Appl. No. 16/302,042, Cutting Unit, Web of Packaging Material, and Method for Cutting Preparation Features Into It, filed Nov. 15, 2018.

* cited by examiner

CUTTING TOOL, AND A METHOD FOR CUTTING A WEB OR SHEET OF MATERIAL

TECHNICAL FIELD

The present invention relates to the field of cutting preparation features in a web or sheet of material, such as in particular packaging materials, and in particular to a cutting tool and cutting method for such packaging material.

BACKGROUND

It is commonly known to use a paperboard based packaging material to form product containers, such as containers for enclosing and storing liquid food.

In order to ensure the required quality of the final package, e.g. in terms of food safety and integrity, the packaging material may comprise different layers. As an example, a laminated packaging material may comprise a paperboard with at least one first plastic layer applied on one side thereof making up the outer surface of the final package, and one or more second plastic compositions or layers on the opposite or inner side. The second plastic composition may in some cases be laminated to a protective layer such as an aluminum foil; the laminated material thus normally also includes an outer, or distal layer on the inner side, which is in contact with the product intended to be contained in the final package.

If the final package is to be provided with a cap or a closure, adjustments to the packaging material need to be made. It is known that before application of any additional layers to the paperboard, the paperboard is adapted to the later application of a cap by incorporation of a hole for that purpose. Another application requiring a hole to be made is e.g. packages having a straw hole.

Such holes are normally cut in the paperboard prior to lamination, i.e. before any polymeric layers are added to form the final packaging material. The cutting process is performed by operating a cutting tool, such as a punching knife to move against a mating anvil. During operation the paperboard to be cut is positioned between the punching knife, forming a male tool, and the mating anvil, forming a female tool.

In order to achieve a high precision cut it is of outmost importance to arrange the male tool and the female tool in perfect alignment. Should there be any offset between the tools the hole will not be cut properly, or the male and/or female tools will be damaged.

Manufacturing of packaging material is run at very high speeds, well above 400 meters per minute. Should there be any misalignment between the tools it is readily understood that a vast amount of packaging material will be wasted if the error is not detected in due time.

In order to reduce the risk of waste of material and improve the cost effectiveness of the entire hole-cutting process, it is not unusual to spend more than one entire day to accomplish the required calibration and alignment of the tools.

In view of this, it would be desired to have more efficient and less sensitive cutting tools for at least partly overcoming the disadvantages of prior art solutions.

SUMMARY

An object of the present invention is to solve the above-mentioned problems.

According to a first aspect, a cutting tool for providing holes in a core material layer is provided. The cutting tool comprises a cutting knife having a cutting edge configured to cut through the core material layer, and a support structure onto which the cutting knife is attached, wherein the support structure is at least partly formed by an elastic material.

In an embodiment the cutting knife comprises a rigid base member from which the cutting edge extends. This facilitates manufacturing of the cutting knife, as it may be formed by the same material as the rigid base member.

The support structure may comprise an elastic member and a rigid support plate, said elastic member being arranged between the rigid support plate and the cutting knife. This is advantageous in that the entire cutting knife may be elastically supported.

In an embodiment the cutting edge extends along a closed path, which closed path may have a circular shape. The cutting tool may thus be particularly advantageous for providing holes, such as circular opening holes, to a packaging material.

According to a second aspect a cutting device is provided. The cutting device comprises a roller and at least one cutting tool according to the first aspect arranged at the outer circumference of said roller. This allows for high-speed operation, as holes may be cut during rotation of the roller.

In an embodiment a plurality of cutting tools is arranged along the outer circumference of said roller.

According to a third aspect a cutting system is provided. The cutting system comprises at least one cutting tool according to the first aspect, and an anvil for supporting a core material layer and for engaging with the at least one cutting tool during use.

The anvil may be formed by a rigid material, for example by forming part of an anvil roller, and the cutting tool may form part of a cutting device according to the second aspect.

In an embodiment the cutting system comprises a plurality of cutting devices arranged along the circumference of said anvil roller, which is advantageous in that each cutting device may be configured for specific packaging materials and/or hole dimensions such that an extremely versatile cutting system is provided.

For facilitating service and/or maintenance at least one cutting device may be moveable radially relative said anvil roller. Should a cutting device be in need for replacement or other action there is no need for shutting down of the entire cutting system.

According to a fourth aspect a method for providing a core material layer with a slit or through hole is provided. The method comprises arranging a core material layer onto a support surface of a rigid anvil, and pressing a circumferential cutting edge of a cutting tool against said core material layer such that a support structure of the cutting tool is deformed while the core material layer is cut.

According to a fifth aspect a method for providing a packaging material is provided. The method comprises providing a core material layer, providing said core material layer with at least one through hole by performing the method according to the fourth aspect, and laminating the cut core material layer to at least one polymeric layer, such that the polymeric layer covers the whole core layer including the cut hole.

SHORT DESCRIPTION OF THE DRAWINGS

FIGS. 1*a-c* are schematic views of a punching process according to prior art.

DETAILED DESCRIPTION

Figure 1A:
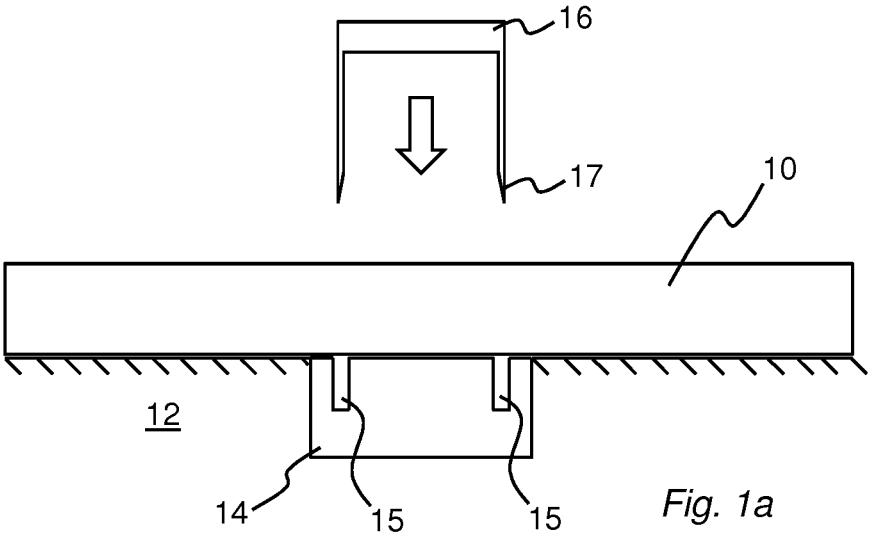
Fig. 1a Prior Art
Figure 1B:
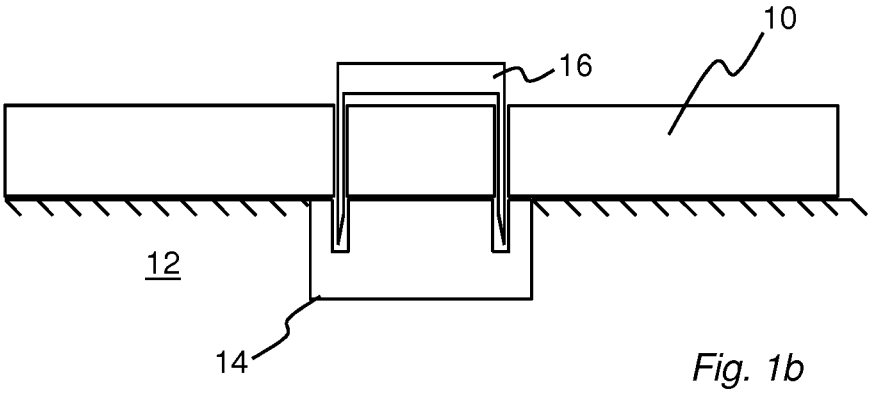
Fig. 1b Prior Art
Figure 1C:
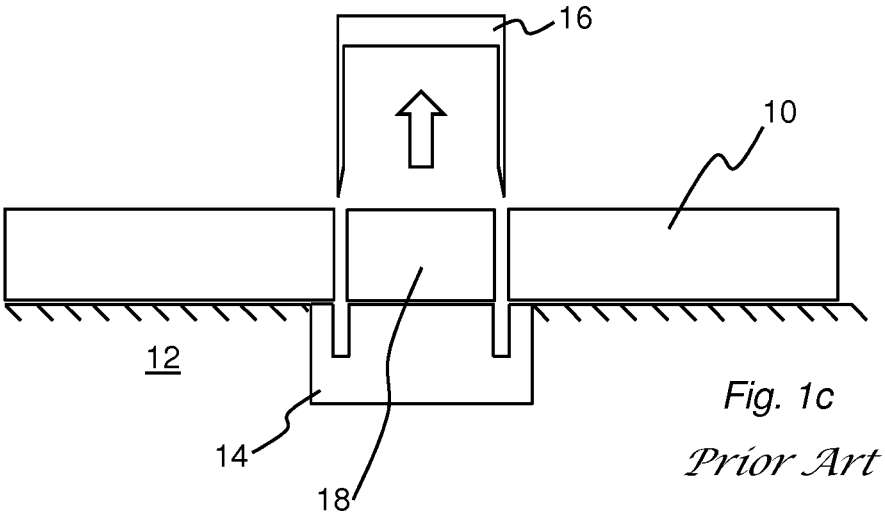
Fig. 1c Prior Art

Starting in FIGS. 1*a-c*, a general method for providing a core material layer 10 with a through hole according to prior art will be described. In FIG. 1*a* the core material layer 10 is arranged onto a rigid support surface 12. The support surface 12, e.g. being formed by a metal, has a recess in which a female tool 14 is arranged. The female tool 14 is dimensioned to receive a male punching tool 16. For this, the female tool 14 is provided with an annular groove 15 having a width being adapted to receive a cutting edge 17 of the male punching tool 16. As the male punching tool 16 moves downwards the cutting edge 17 will cut through the core material layer 10 until the entire core material layer 10 is punched. At this point, best illustrated in FIG. 1*b*, the cutting edge 17 of the male punching tool 16 is received by groove 15 of the female tool 14. As the male punching tool 16 retracts upwards the cut portion 18 may be ejected. As is clear from FIGS. 1*a-c*, alignment of the female tool 14 relative the male tool 16 is crucial in order for the cutting edge 17 to be received by the groove 15 of the female tool 16.

As is evident from the description of the prior art system, should there be any misalignment between the male tool 16 and the female tool 14 there is a risk that the cutting edge 17 of the male tool 16 will come into contact with parts of the female tool 14. This particular risk is even more problematic since the width of the groove 15 of the female tool 14 should be dimensioned such that there is tight fit between the walls of the groove 15 and the cutting edge 15 of the male tool 16 in order to provide a nice cut of the core material layer 10. A very small tilt or displacement of the male tool 16 relative the female tool 14 will consequently lead to a reduced quality of the cut, and even damage of the male tool 16, the female tool 14, or both.

Figure 2:
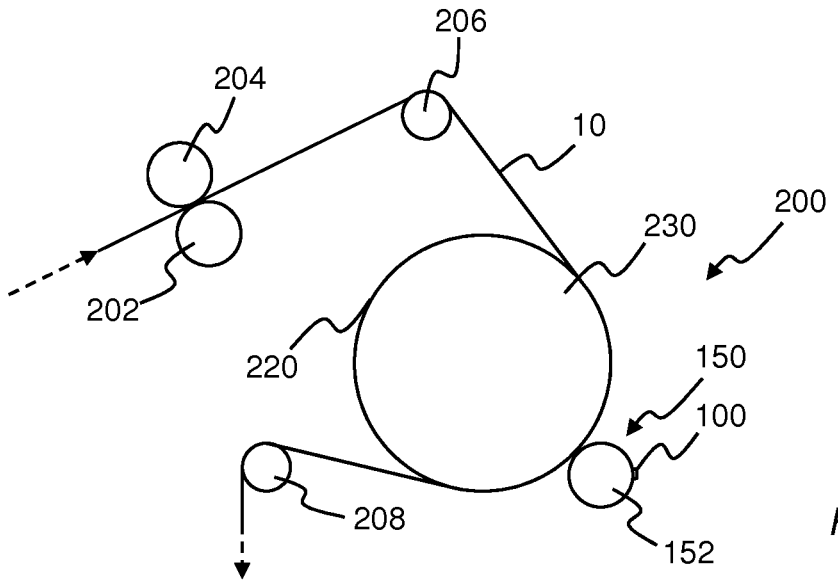
FIG. 2 is a schematic view of a cutting system having a cutting tool according to an embodiment.

Now turning to FIG. 2 an improved cutting system 200 according to an embodiment is shown. As will be explained in the following the cutting system 200 greatly reduces the need for alignment between parts of the cutting system 200.

The cutting system 200 comprises a cutting device 150 in the form of a roller 152 having a cutting tool 100 attached to it. The roller 152 is configured to rotate against an anvil 220 in the form of an anvil roller 230. The anvil 220 has a rigid outer surface. A web of a core material layer 10, which will later be described to form part of a packaging material, is fed through the cutting system 200 via one or more guiding rollers 202, 204, 206, 208. Preferably, the diameter of the anvil roller 230 is substantially larger than the diameter of the cutting roller 152 in order to allow the part to be cut of the core material layer to be substantially planar when the cutting tool 100 engages with the core material layer 10. Hence, as the cutting roller 152 is rotating against the anvil roller 230 the cutting tool 100 will periodically come into contact with the core material layer 10, whereby a hole is cut out from the core material layer 10. By utilizing a rotational system as described with reference to FIG. 2 it is possible to operate the cutting system 200 at very high speed. It is further relatively easy to control the final position of the cut-out/hole in the core material layer 10 by adjusting the rotational speed of the cutting roller 152 relative the feeding speed of the core material layer 10.

Figure 3:
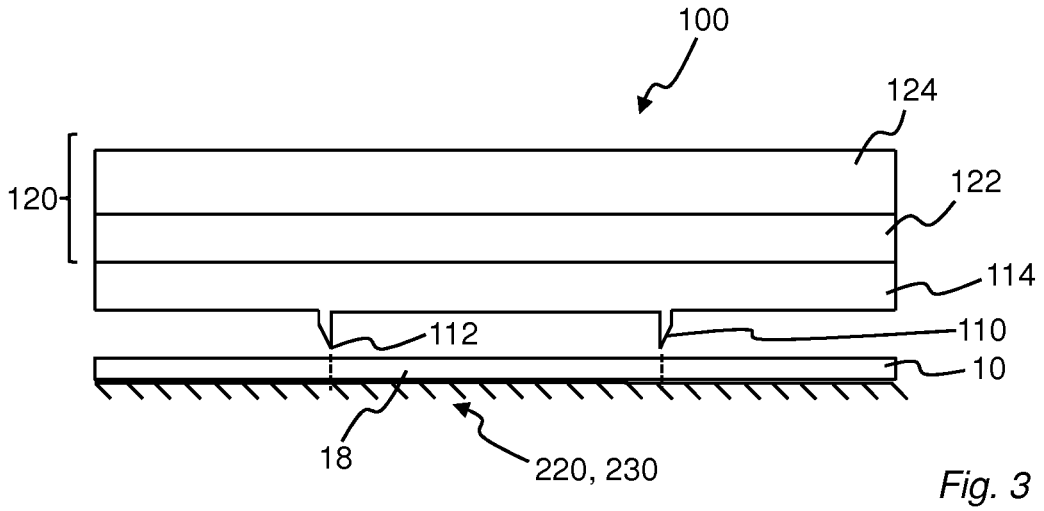
FIG. 3 is a cross-sectional view of a cutting tool according to an embodiment.

Now turning to FIG. 3 a more detailed view of the cutting tool 100 is shown. The cutting tool 100 comprises a cutting knife 110 having a circumferential cutting edge 112 being configured to cut through the core material layer 10 such that the cut-out portion 18 of the core material layer 10 may be removed in order to form a hole in the core material layer 10.

The cutting knife 110 is preferably provided with a rigid base member 114 from which the cutting edge 112 extends; the rigid base member 114 may have a planar shape wherein the cutting knife 110, and its associated cutting edge, is projecting outwards from the rigid base member 114 in a direction towards the core material layer 10 to be cut.

The cutting knife 110 may in some embodiments be formed integrally with the rigid base member 114. For achieving high robustness and accuracy of the cutting system 200 the cutting knife 110 and the rigid support member 114 may be made of steel or any other suitable metal.

For providing circular holes in the core material layer 10 the cutting knife 110 may have a circular circumferential shape, meaning that the cutting edge 112 forms a circular shaped distal circumference of the cutting tool 110. Hence, the cutting knife 110 may be a tubular body extending towards the core material layer 10, wherein the distal end of the cutting knife 110 forms the cutting edge 112. As mentioned the cross-section of the tubular body of the cutting knife 110 may be circular in order to provide circular holes in the core material layer 10; however, should other shapes be preferred for the holes the cross-section of the tubular body of the cutting knife 110 should be configured accordingly. Other shapes of the cutting knife 110, and hence of the resulting hole in the core material layer 10 may e.g. be elliptical, rectangular, triangular, etc. It should be realized that other shapes and dimensions of the cutting knife 110 could be utilized as well; e.g. the cutting knife 110 could be configured to provide straight or curved slits or perforation lines.

The rigid base member 114 is arranged onto a support structure 120 being at least partly formed by an elastic material. The elastic properties of the support structure 120 will allow for a small deformation of the support structure 120 when the cutting tool 100 is pressed against the anvil 220. By allowing for such deformation, which normally is within 0.003-0.01 mm in a radial direction, the process window for the cutting operation is increased significantly thus reducing the risk of damaging the equipment and/or the core material layer 10 while still providing a good result.

During operation the distance between the cutting roller 152 and the anvil roller 230 is set such that the cutting edge 112 will actually come into contact with the planar surface of the anvil 220 when the cutting tool 110 has penetrated the core material layer 10; with the term "planar" it should be understood that any continuous surface is meant to be included, such as a slightly convex surface provided as a result of the radius of the anvil roller 230. As the anvil surface is planar there is no need for alignment of any female tools thus greatly reducing the required set-up time for the cutting system 200.

The deformability of the support structure 120 is in this particular embodiment realized by means of an elastic member 122 arranged in contact with the rigid base member 114 of the cutting knife 110 on a side of the rigid base member 114 being opposite the side facing the core material layer 10. The counterforce acting on the cutting knife 110 during operation, i.e. when the cutting knife 110 is pressed against the anvil 220, will thus be transferred from the cutting edge 112 to the elastic member 122 which deforms accordingly. Preferably, the elastic member 122 is made of vulcanized rubber, although other materials may be used as well.

The elastic member 122 is preferably arranged onto a rigid support plate 124. The rigid support plate 124 may for example form the core cylinder of the anvil roller 230. In such case the rigid support plate 124 will experience a convex outer surface onto which the elastic member 122 can be attached. In other embodiments the rigid support plate 124 forms an adapter for attachment to the convex surface of the anvil roller 230. The rigid support plate 124 of the cutting knife 110 may e.g. be made of steel, as has already been suggested for the rigid base member 114 of the support structure 120.

Figure 4:
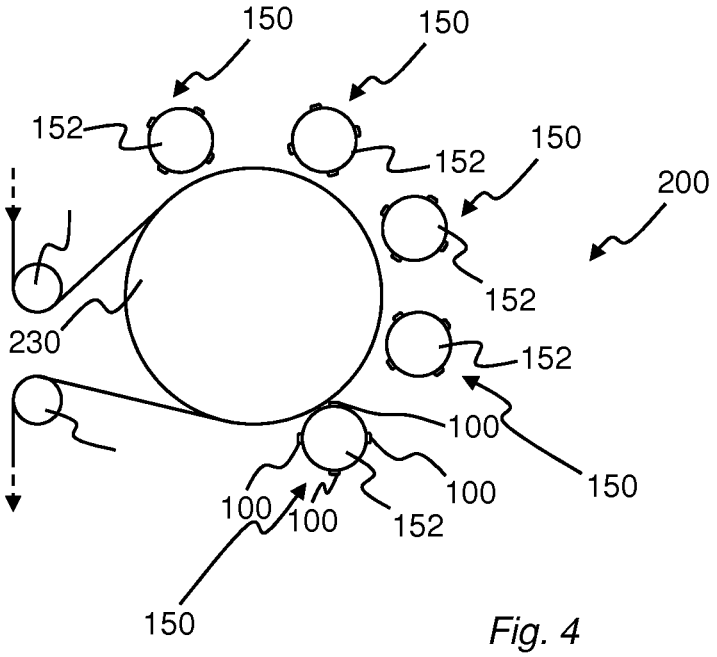
FIG. 4 is a schematic view of a cutting system according to a further embodiment.

Now turning to FIG. 4 another embodiment of a cutting system 200 is shown. The cutting system 200 comprises an anvil roller 230 being similar to the roller 230 described with reference to FIG. 2; i.e. the roller 230 forms a rigid anvil 220 for the cutting process.

Preferably the rigid anvil 220 has a continuous outer surface, such that a small area having dimensions corresponding to the size of the hole to be cut, will be planar within the context of this description.

The cutting system 200 further includes a plurality of cutting devices 150, each cutting device 150 having one or more cutting tools 100. In this particular example, five cutting devices 150 are provided, each cutting device 150 having four cutting tools 100 spaced apart along the circumference of the respective cutting roller 152. It should however be realized that any number of cutting devices 150 and/or cutting tools 100 could be provided as long as they fit with the available equipment.

Further, it should be noted that the above example of having four cutting tools 100 being spaced apart along the circumference could be expanded such that additional cutting tools 100 are provided along the axial direction of the respective cutting roller 152. Hence, again making reference to the example above each cutting roller 152 may be provided with rows of cutting tools 100, wherein each row of cutting tools 110 is distributed along the axial extension of the roller 152, and being circumferentially spaced apart from adjacent rows of cutting tools 100.

In other embodiments the cutting tools 100 may be distributed at non-equal distances both in axial and circumferential direction, depending on the respective desired positions of the holes of the core material layer.

Each cutting roller 152 may for example be provided with a plurality of connection areas, wherein a cutting tool 100 could be mounted to a selected connection area by means of e.g. screws or similar. As the cutting tool(s) 100 will protrude radially outwards from the connection area the cutting system 200 will work perfectly without the need of mounting cutting tools 100 to each connection area.

In a specific embodiment one or more cutting devices 150 may be associated with a specific type of holes to be cut. Hence, the cutting devices 150 are preferably moveable radially relative the anvil roller 230 such that they may be controlled to be in engagement, or contact, with the anvil roller 230 or not. For a specific hole type, one or more of the cutting devices 150 are moved to engagement with the anvil roller 230 while the remaining cutting devices 150, configured to provide another hole type, are moved radially away from engagement with the anvil roller 230. In this manner it will be very easy to change the hole design, as the unused cutting devices can be configured accordingly while the cutting system is still running. Also, service and/or maintenance of the cutting tools 100 may also be accomplished without stopping operation of the cutting system 200, as long as it is the non-operating cutting tools 100 that need to be replaced or repaired.

For example, if a specific type of core material layer is being fed through the cutting system 200 it may be desired to provide two different holes to the core material layer 10. This may be the fact if the core material layer 10 is a web having a width corresponding to two adjacent but different package types. The left side of the web of core material layer 10 may e.g. be intended to form a 250 ml package of liquid food product, while the right side of the web of the core material layer 10 is intended to form a 1000 ml package of liquid food product. Further process steps of providing crease lines, lamination, and longitudinal separation of the two different types of packaging material is thus required. However for such web of core material layer 10 one cutting device 150 may be provided with cutting tools 100 designed to provide straw holes to the left side of the core material layer 10. Hence, the cutting tools 100 may be distributed only at a certain axial extent so that no straw holes are made to the right hand side of the core material layer. In a similar manner another cutting device 150 may be provided with cutting tools 100 designed to provide holes for an opening device to the right hand side of the core material layer 10. For this cutting device the cutting tools 100 may be distributed only at a certain axial extent so that no holes are made to the left hand side of the web of core material layer 10.

The cutting system described above has proven to be particularly advantageous for high speed operation, where a web speed well above 400 meters per minute is utilized. Still for this high speed accurate cutting is accomplished.

Figure 5:
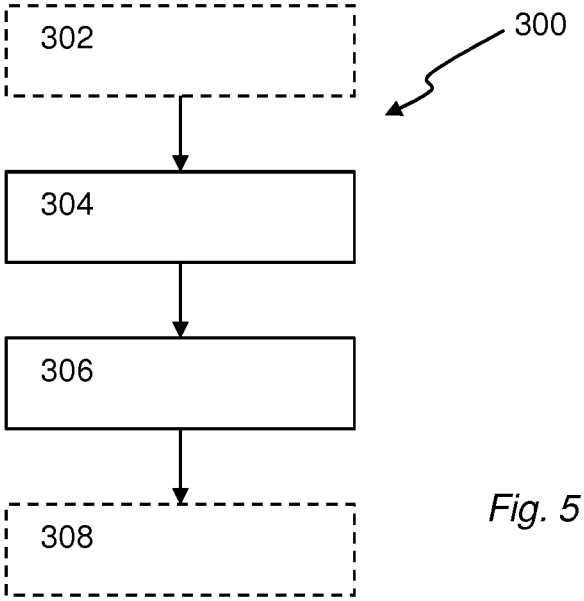
FIG. 5 is a schematic view of a method according to an embodiment.

According to an embodiment, a method 300 for providing a core material layer with a through hole is schematically illustrated in FIG. 5. The method 300 includes a first step 304 of arranging a core material layer onto a support surface of a rigid anvil, and a second step 306 of pressing a circumferential cutting edge of a cutting tool against said core material layer such that a support structure of the cutting tool is deformed while the core material layer is cut. Preferably, the cutting tool and the anvil form part of a cutting system as described above with reference to FIGS. 2-4.

The method 300 may further be configured to a method for providing a laminated packaging material. According to such aspect the method 300 includes an initial step 302 of providing a core material layer, and a final step 308, performed after step 306, in which the cut core material layer is provided with at least one polymeric layer, which is laminated to the core layer across its entire surface, including the area of the hole, thus forming a so-called laminated hole.

The packaging material thus comprises a core material layer, an outer layer, and an inner layer, wherein the outer layer and inner layers are applied to opposite sides of the core material layer after the at least one hole is cut. The outer layer applied to one side of the core material layer is adapted to provide the outer surface of a package to be produced, which outer surface and outer layer faces the surroundings of the package. The inner layer is applied to the other side of the core material layer and is adapted to provide the inner surface of a package to be produced which is in contact with the material contained in the package.

The core material may be a sheet for providing rigidity to the packaging material, and may preferably be made of core material or cardboard.

The outer layer may comprise at least one layer of polymer material, which is applied to the core material layer. Moreover, one of the layers making up the outer layer may be an outermost plastic layer covering a decorative layer making up the outer surface of the packaging to be formed.

A printing layer may be included onto the core material layer, adjacent to the outer layer.

The inner layer may comprise at least one layer of polymer material.

A protective layer may be present between the core material layer and the inner layer. The protective layer may be a foil, such as a metal foil, preferably an aluminium foil. The protective layer protects against oxygen to maintain the nutritional value and flavours of the food in the package at ambient temperatures.

In addition, a lamination layer may be present between the protective layer and the core material layer. The lamination layer may be at least one layer of polymer material.

According to one embodiment, the layers of the packaging material intended for the inside of a finished package, which is in contact with the material contained in the package comprises starting from the core material layer: a lamination layer, a protective layer and an sealing layer. The lamination layer enables the core material to adhesively bond to any protective layer applied. The sealing layer enables package sealing by heat welding of opposite surfaces of the sealing layer to each other.

The polymer layers of the packaging material may be any type of polymer material, preferably a plastic material such as polyethylene.

Different types of containers may be obtained from the packaging material. A packaging material or a container according to the present invention may be used for foodstuffs which preferably may be liquid.

The invention claimed is:

1. A cutting system comprising:

a plurality of cutting devices, each cutting device comprising:

a cutting roller, a cutting knife including a cutting edge configured to cut through a core material layer, and a support structure onto which the cutting knife is attached, wherein the support structure comprises an elastic member at least partly formed by an elastic material and a rigid support plate, said elastic member being arranged between the rigid support plate and the cutting knife, and wherein the rigid support plate forms a core cylinder of said cutting roller; and an anvil configured to support the core material layer and to engage with the plurality of cutting devices during use, wherein said anvil forms part of an anvil roller, wherein the cutting devices are arranged along a circumference of said anvil roller.

2. The cutting system according to claim 1, wherein the cutting knife comprises a rigid base member from which the cutting edge extends.

3. The cutting system according to claim 1, wherein the cutting edge extends along a closed path.

4. The cutting system according to claim 3, wherein said closed path has a circular shape.

5. The cutting system according to claim 1, wherein said cutting knife is arranged at an outer circumference of said cutting roller.

6. The cutting system according to claim 5, wherein a plurality of cutting knives is arranged along the outer circumference of said cutting roller.

7. The cutting system according to claim 1, wherein said anvil is formed by a rigid material.

8. The cutting system according to claim 1, wherein at least one cutting device of the plurality of cutting devices is moveable radially relative to said anvil roller.

9. A method for providing a core material layer with a through hole, comprising:

arranging a core material layer onto a support surface of a rigid anvil, and pressing a circumferential cutting edge of a cutting tool against said core material layer such that a support structure is deformed while the core material layer is cut, the support structure comprising an elastic member and a rigid support plate, said elastic member being arranged between the rigid support plate and the cutting tool, wherein the rigid support plate forms a core cylinder of a cutting roller.

10. A method for providing a packaging material, comprising:

providing a core material layer, providing said core material layer with at least one through hole by performing the method according to claim 9, and providing the cut core material layer with at least one polymeric layer.

11. The method according to claim 10, wherein the at least one polymeric layer is laminated to the cut core material layer.

12. The method according to claim 11, wherein the at least one polymeric layer is laminated to the cut core material layer across substantially entire surface of the cut core material layer.

13. The method according to claim 10, wherein the at least one polymeric layer comprises a first polymeric layer provided on a first side of the cut core material layer and a second polymeric layer provided on a second side of the cut core material layer, the second side opposite the first side.

* * * * *